US006065269A

United States Patent [19]

Malnati

[11] Patent Number: 6,065,269

[45] Date of Patent: May 23, 2000

[54] AUTOMATIC WRAPPING APPARATUS FOR PACKAGES OF PALLETISED LOADS, PARTICULARLY SUITABLE TO ACHIEVE HIGH PRODUCTIONS

[75] Inventor: Fabio Malnati, Cassina de Pecchi Mi, Italy

[73] Assignee: FIS Impianti S.r.l., Cassina de Pecchi MI, Italy

[21] Appl. No.: 09/096,843

[22] Filed: Jun. 12, 1998

[30] Foreign Application Priority Data

Jun. 17, 1997 [IT] Italy ..... MI97A01419

[51] Int. Cl.[7] ..... B65B 11/04; B65B 11/00

[52] U.S. Cl. ..... 53/176; 53/587; 53/588

[58] Field of Search ..... 53/399, 441, 556, 53/587, 588, 176, 591, 210, 211

[56] References Cited

U.S. PATENT DOCUMENTS 4,628,667 12/1986 Humphrey et al. ..... 53/587 X 5,131,209 7/1992 Schreiber et al. ..... 53/587 X 5,155,970 10/1992 Moore ..... 53/587 X 5,802,805 9/1998 Oistad ..... 53/176

*Primary Examiner*—Linda Johnson

*Attorney, Agent, or Firm*—Collard & Roe, P.C.

[57] ABSTRACT

Packing process for palletized loads, positioned on a revolving or fixed platform of a packing structure providing to the helical wrapping about the load of a plastic film and according to two spirals, each of said spirals being partly superposed; said process consists in utilizing two separate and independent coils of plastic film, in submitting them at the same time to a vertical translation in both directions and parallel to the vertical axis of the load, whereby the start of the wrapping by a coil is alternate to that of the other coil, starting from down upwards or from up downwards and with the same translation speed, so as to obtain a complete wrapping, constituted by two spiral helixes separate and directed towards opposite directions, in substantially half the time with respect to the time required by the present wrapping systems.

5 Claims, 7 Drawing Sheets

Figure 1:
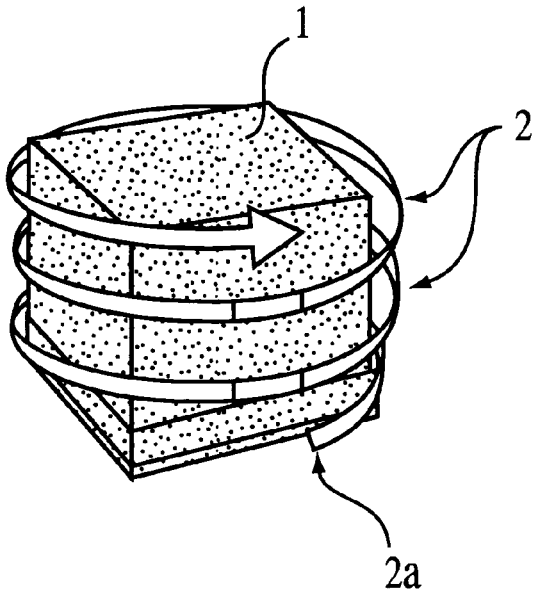

AUTOMATIC WRAPPING APPARATUS FOR PACKAGES OF PALLETISED LOADS, PARTICULARLY SUITABLE TO ACHIEVE HIGH PRODUCTIONS

The present invention relates to a fully automated process for the realisation of packages of palletised loads by the known systems of wrapping around the load a plastic film, according to partly superposed spirals, so improved as to allow package productions much higher than those achievable by the present packing installations.

The present invention also relates to a particular automatically working apparatus for the concrete implementation of said packing process.

As is known, there are at present commercially available many types of automatic packing machines utilising plastic films applied around the load by means of a lateral superposed spiral wrapping, to obtain stable packages of various palletised materials. The automatic packing machines most known in the field of palletised loads are without any doubt the so-called "revolving platform", "rotary arm and robot" machines; in both said packing machines there is used, to wrap the load, a thin plastic film, selected from among extensible, self-sticking thermo-retractable films and the like.

More particularly, the packing machines of the type with a revolving platform are generally constituted by: a basement with guide and translation uprights for a trolley bearing a coil of plastic sheet, usually of the extensible, self-sticking type; a revolving platform provided with motor-driven rollers, intended for supporting the palletised load to be packed; a revolving lid to press the load during the wrapping; and by pliers mounted on the revolving platform, to grip the end of the sheet least it, having completed the wrapping, be separated by cutting means not integral with the revolving platform.

Besides, this packing machine is also provided with an electro-mechanical braking device, associated to said coil-holding trolley, to obtain the desired tension for the unwrapping film, as well as ratio-motors for the rotation of said platform and said pressing lid, should the latter be present.

In this packing machine the wrapping of the load placed on the supported pallet of the platform takes place helically, according to a partly superposed spiral, due to the combination of the ascending and descending movement of the plastic sheets with the rotation movement of the load.

The sequence of the interventions of the locking-unlocking device of the pliers and of the cutting one, as well as the intervention of various devices of regulation and control of all the cyclically repeating functions, such as the number and speed of the platform carrying up- and downwards the film coil, the start and the stop of the ratio-motors are regulated, in the automatic packing machines by a suitably programmed and adjustable electronic logic.

The rotary arm packing machines are provided with a fixed platform supporting the load and a frame usually constituted by two uprights protruding from both platform sides and circumscribed on the top by a tie-rod; centrally to this tie-rod a support is revolvingly mounted that bears a vertical arm, parallel to the side uprights, on which a trolley holding a coil of plastic material is mounted than can translate vertically and in both directions. Pliers are integral with the fixed platform.

Also in this case, the wrapping takes place helically, with a partly superposed spiral due to the combination of the ascending and descending shifting of the coil with the rotation of said coil about the palletised load which is held still.

This type of wrapping machine with an arm revolving about the load is particularly suitable for poorly stable and light loads, so that to keep them safely still during the wrapping, the wrapping machine is provided with a stabilising presser.

In the practice, these types of automatic packing machines are very reliable and allow to realise safely stable packings for loads of various sizes and with wrapping speeds that are usually sufficient to allow a good hourly production.

However, as the market of these packing machines tends always to having at disposal machines that can supply an always increasing production capacity, in particular if special products have to be packed, the present packing machines are not such as to fully satisfy the requirements of a markedly greater production capacity. This can obviously be achieved by utilising two or more packing machines, but these, besides involving installation costs that cannot always be borne by users, require spaces that are not always available and higher protection systems, for instance wider fences and more assistance personnel with the related higher costs.

Therefore, the main object of the present invention is to provide a packing process of palletised loads by wrapping with superposed spirals of a plastic film of a known type, so designed as to prevent the expounded drawbacks and limitations, as concerns at least the production capacity, of the present individual packing machines of either the revolving platform or the rotary arm type, with obvious high economic and practical advantages, as concerns both the reliability and the working life.

Another object of the invention is to provide a packing apparatus for the realisation of said process, so structured as to be simple and reliable from the construction point of view, with overall dimensions substantially equal to those of the packing machines of the known art, and especially such as to be able to perform packing of palletised loads within a time reduced by up to 50%, depending on the number of wrappings of plastic film to be made about the load.

A further object of the invention is to provide a packing apparatus so designed and structured as to be in condition of making the wrappings of palletised loads positioned either on a revolving platform or a fixed platform and, in both cases, to very contained additional costs, with respect to the known packing machines.

A not least object is to provide a packing machine of palletised loads that can utilise, for the wrapping with partly superposed spirals, a plastic film selected from among self-sticking extensible films, thermo-retractable films, and the like.

These and still other objects, that will be more clearly explained hereinafter, are achieved by a packing process for palletised loads, positioned on a revolving platform, a fixed platform or also directly on the ground, of a structure of a packing machine of a known type, by wrapping a plastic film about the load in helical direction and according to a partly superposed spiral, which process consists, according to the present invention, in utilising two separate and independent coils of plastic film, submitting them at the same time to a vertical translation in both directions and parallel to the load vertical axis, whereby the start of the wrapping by a coil is alternate to that of the other coil, starting from down upwards or from up downwards and with the same translation speed, so as to obtain a complete wrapping, constituted by two separate spiral helixes, each of which is partly superposed and directed in the opposite direction relatively to the other one, in substantially half the time with respect to the time required by the present wrapping systems.

More particularly, said packing process utilises, as wrapping film, preferably an extensible self-sticking plastic film having a width preferably comprised between 500 and 600 mm.

For the practical implementation of said packing process for palletised loads, a wrapping apparatus is used which is partly of a known type, namely of the type comprising: a usual revolving platform, a film coil mounted on a trolley translatable along an upright, usual pliers for gripping the film, before the separation from the wrapping spiral with cutting means, driving means for the translation of said coil-holding trolley and for the rotation of the platform, braking means for the correct tensioning of the film during the wrapping stage and a pressing lid, which apparatus is constituted, according to the present invention, by two like uprights, arranged in opposite position relatively to the revolving platform supporting the load to be packed, and provided each with a continuous guide for the vertical sliding, and in both directions, a coil-holding trolley with the related braking device, two cutting devices for the separation of the ends of the films upon conclusion of each wrapping, and two pliers for gripping the film after each cut, one of which is integral with said revolving platform and the other one with said pressing lid, so as to allow, through the simultaneous translation in alternate direction of said two coils, whereby the start is from down upwards or vice-versa, the wrapping of the load by means of two separate spiral helixes partly superposed to each other, realised at the same time by one only run of each of said coils, being lastly also provided means such as electro-welding or the like, for anchoring the couples of tails of the two films to said packing, after the cutting of the respective coils, both above and under the load.

Also according to the invention, said two coil-holding trolleys may be so mounted as to be vertically translatable in both directions along guides obtained in two separate parallel and vertically arms revolving around a fixed platform supporting the palletised load, so as to obtain to separate wrapping helixes with alternate start of the coil-holding trolleys and with pliers integral with the fixed platform and the pressing lid, and cutting means so realised as to allow the separation of the film ends upon conclusion of each wrapping, independently on whether the coil is in an upper or a lower position.

Figure 1A:
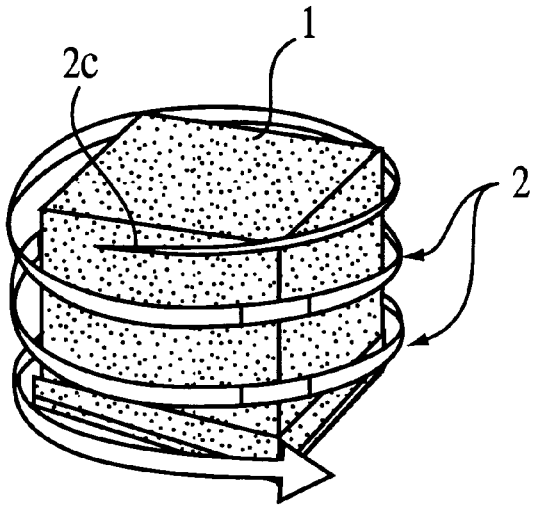
Figure 2:
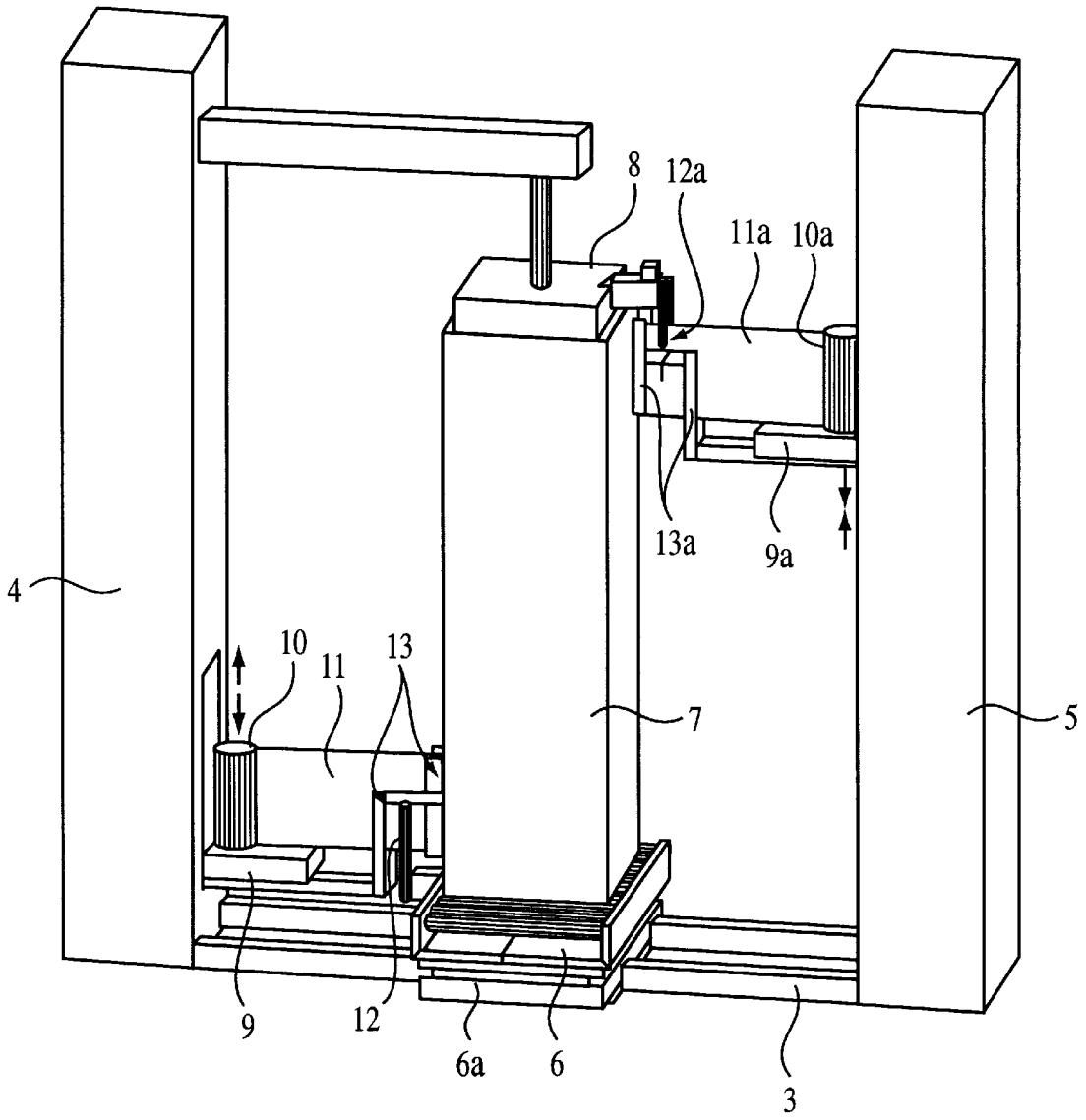
Figure 3:
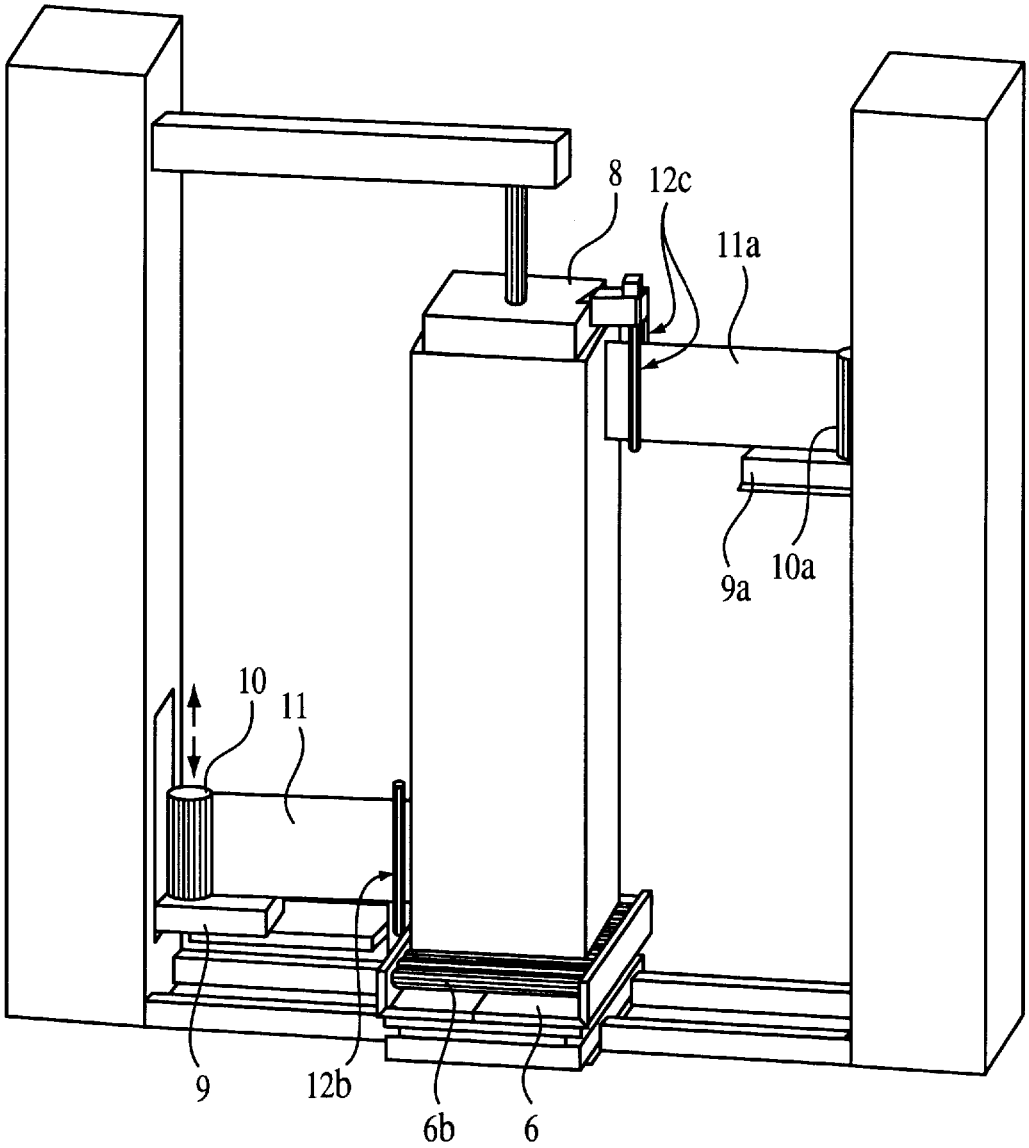
Figure 3A:
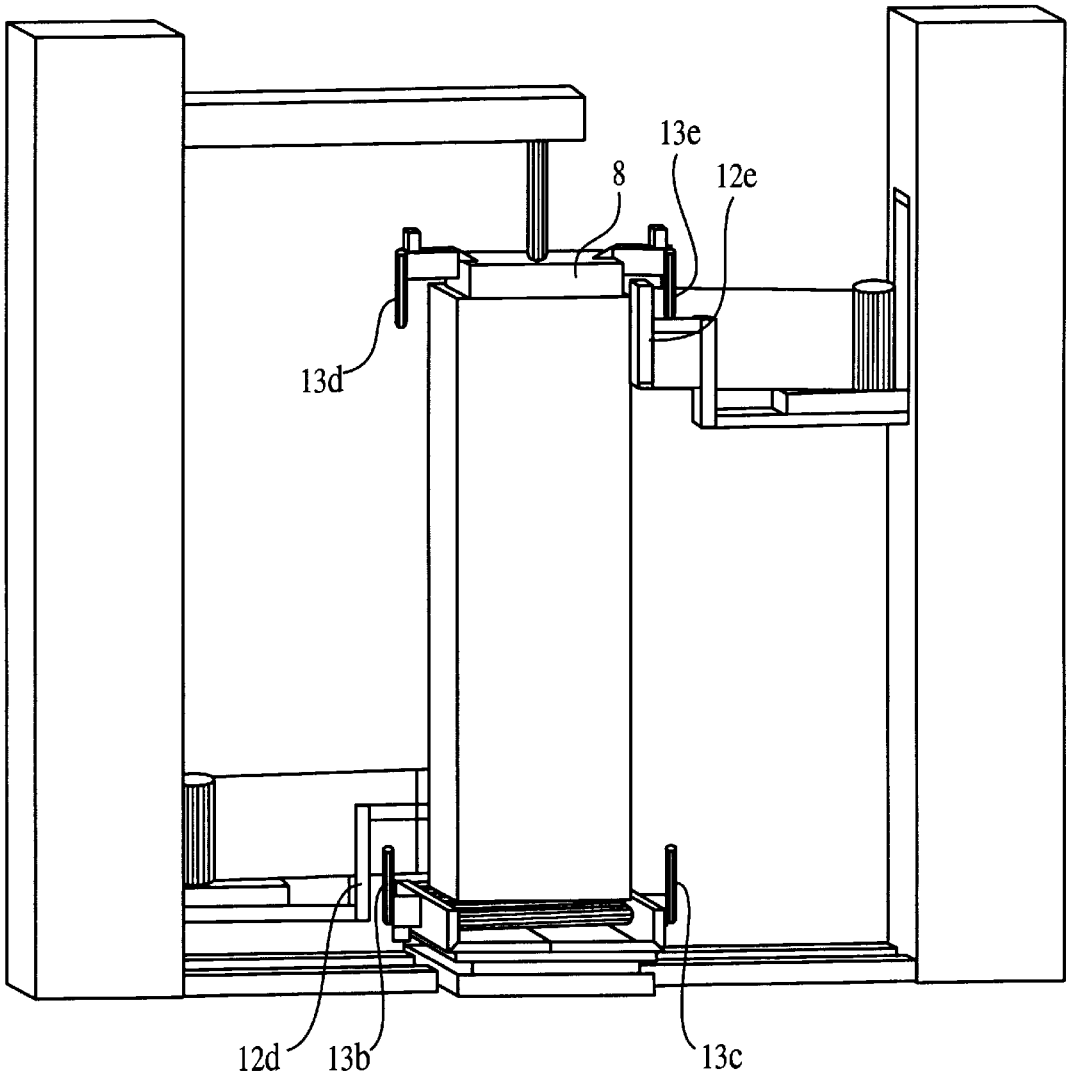
Figure 3B:
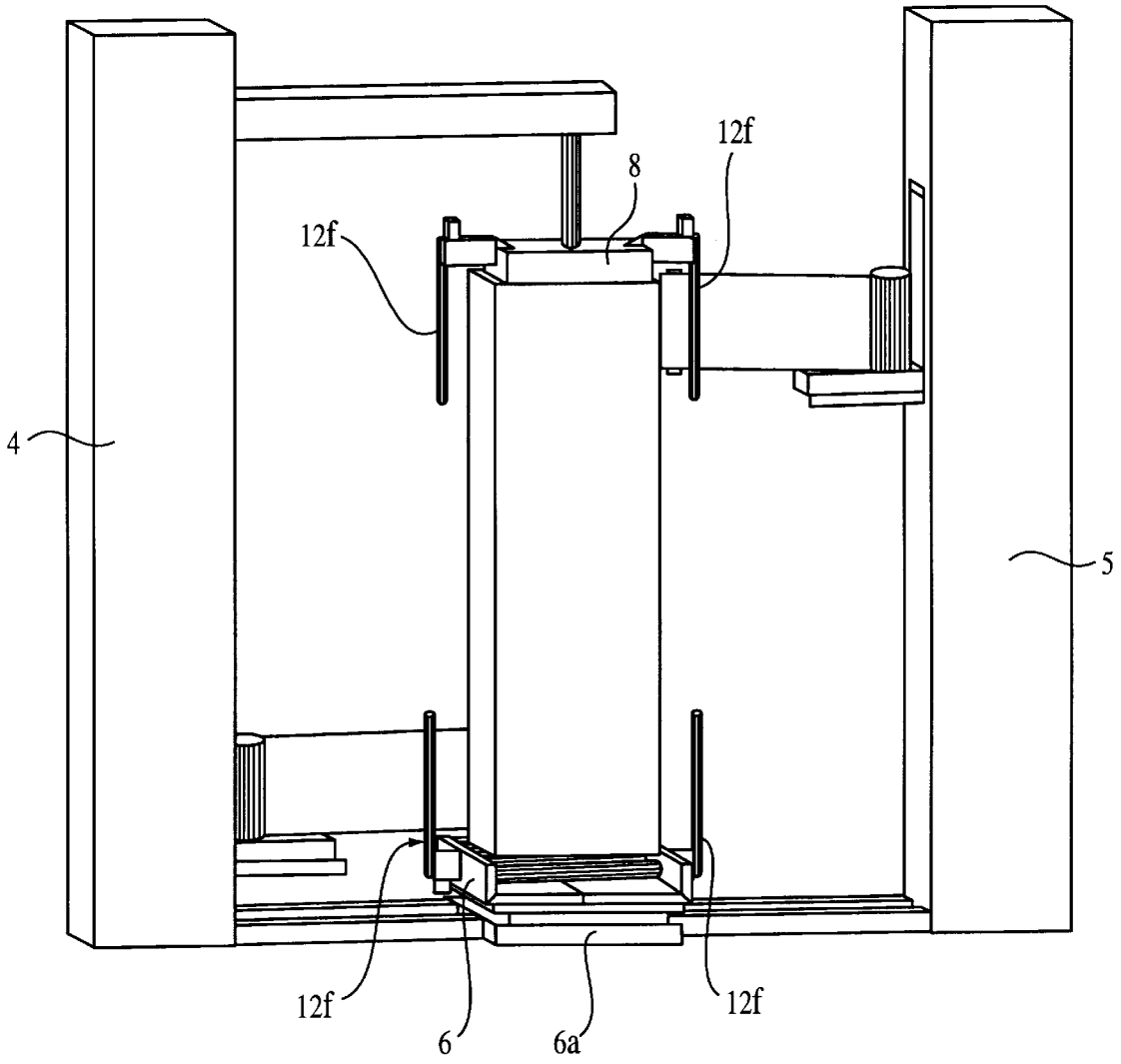
Figure 4:
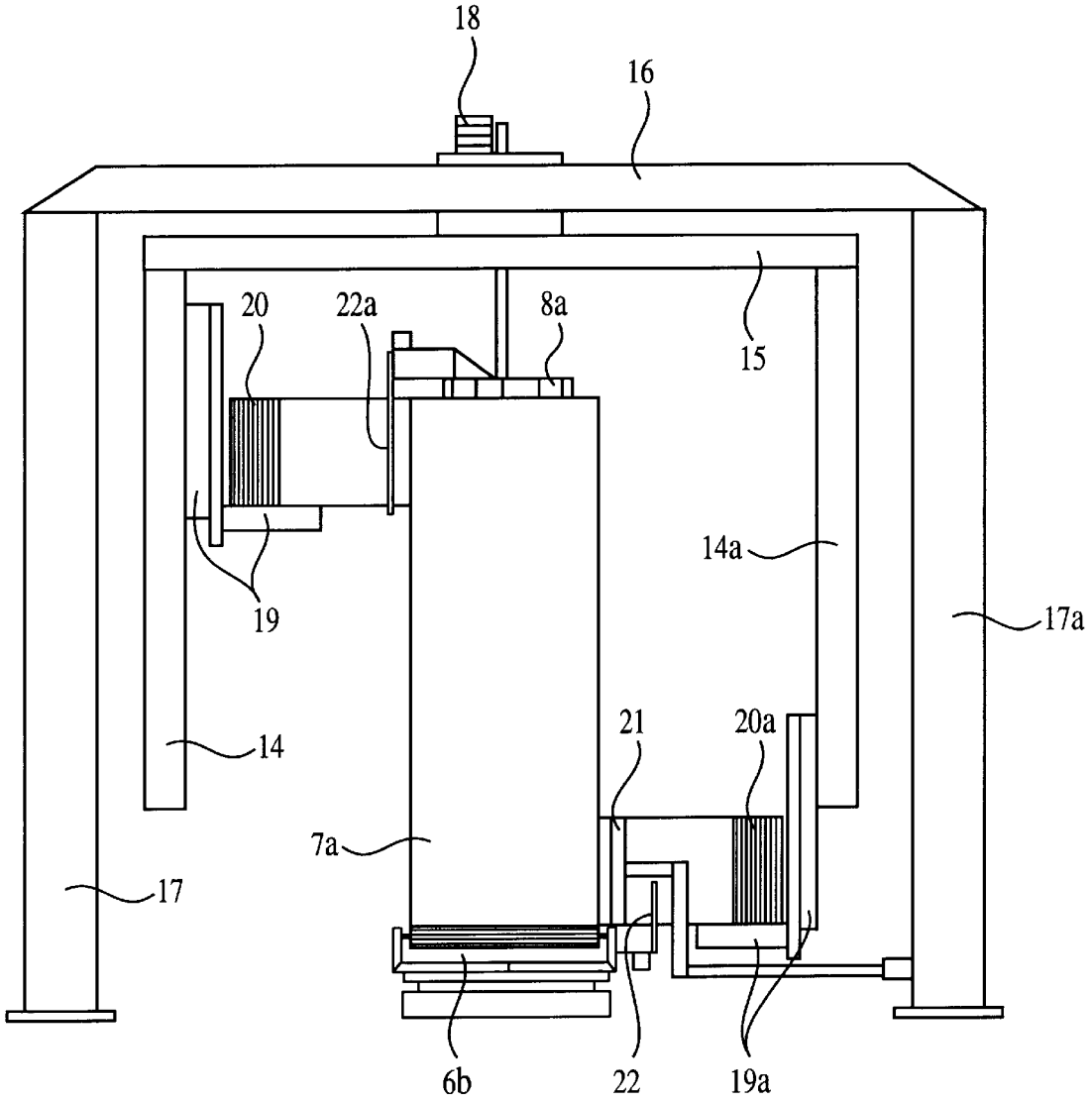
Figure 5:
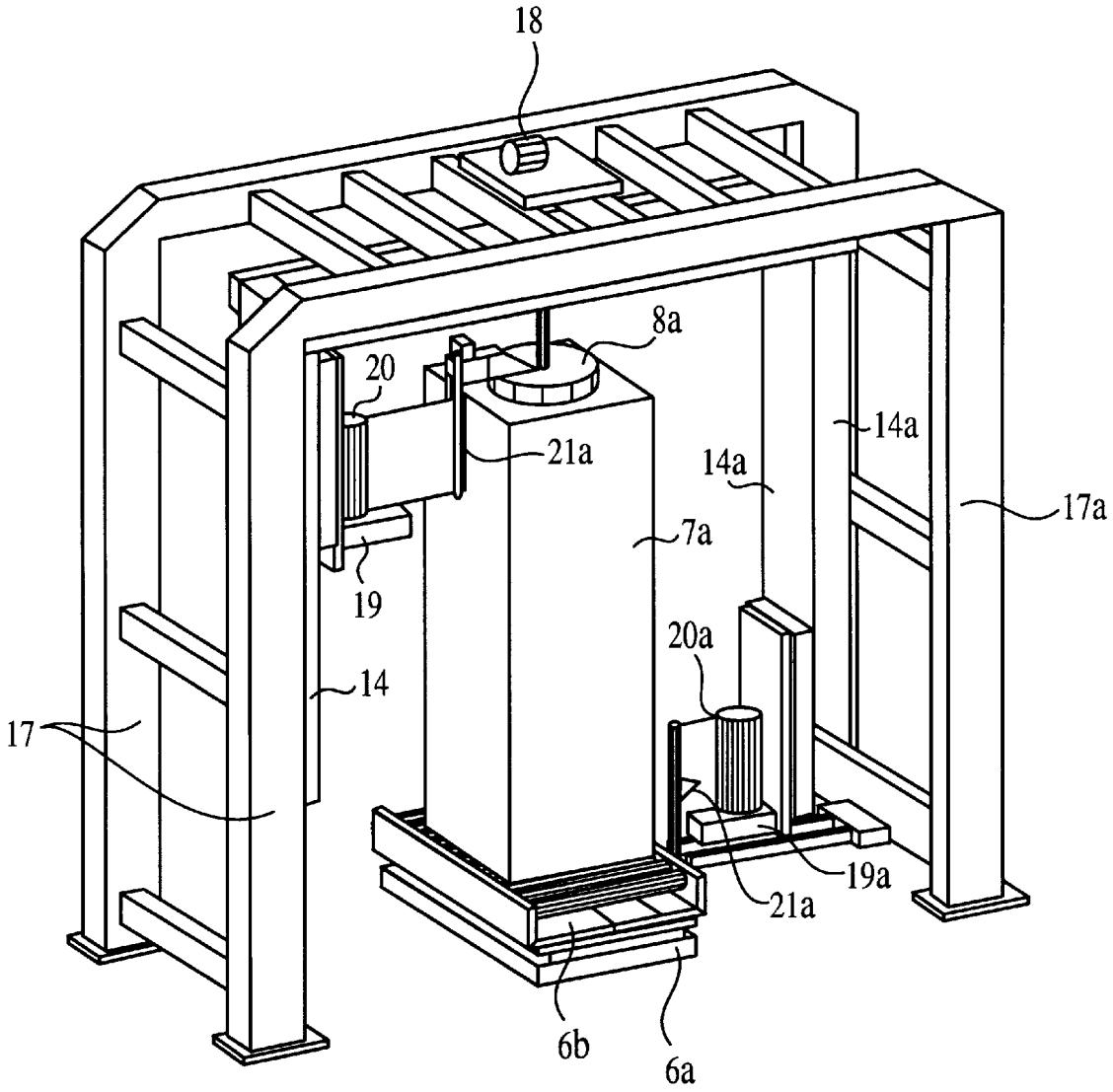

Further characteristics and advantages of the present invention will be better stressed by the following detailed description, made with reference to the attached tables of drawings, solely given by way of non limiting indication, wherein:

FIGS. 1 and 1*a* show schematically two separate helixes realised by means of two wrappings of a plastic film around a load, with the purpose of demonstrating how a complete packing is made with the apparatus subject matter of the present invention;

FIG. 2 shows schematically a prospect view of a packing apparatus of the revolving platform type, realised according to the present invention;

FIGS. 3–3*a*–3*b* show, always schematically and in prospect view, the same apparatus of the revolving platform type of FIG. 2, provided with means of different type for cutting and gripping the film, also object of the present invention;

FIG. 4 shows, schematically and in prospect view, a packing machine with two coil-holding arms revolving around a fixed palletised load, also realised according to the invention and a first embodiment, while, FIG. 5 shows, always schematically and in prospect view, the same apparatus of FIG. 4, realised with a different combination of devices for cutting and gripping the film.

With reference to said figures, and in particular to FIGS. 1–3, the apparatus shown in the same is so structured as to realise a helical wrapping process for a load palletised on a revolving platform by means of two separate wrapping plastic films with partly superposed spirals, fed by two separate coils. More precisely, FIGS. 1 and 1*a* illustrate, schematically and separate from one another on one only palletised load 1, a first spiral helix 2, with start from down upwards, as indicated by 2*a*, and at the same time a second spiral helix 2*b*, with start from up downwards as indicated by 2*c*; in this way the full wrapping of load 1 is made within a time that is about half the time required by the present wrapping machines with one only coil, wherein the coil is usually subject to an upwards run and to a similar downwards run.

For the realisation of said wrapping with two separate coils, there is provided, according to the present invention and a first embodiment, a packing apparatus constituted by an usual basement 3 supporting two columns or uprights 4 and 5 (FIGS. 2, 3), arranged, preferably though not exclusively, in a position diametrically opposed to an usual revolving platform 6, with motor-rollers, whereon load 7 to be packed is positioned; above the load, an adjustable presser 8 is provided, of a known type.

In both columns 4 and 5 there is obtained in a known manner a longitudinal guide (not represented in the figure) taking up in practice the whole length of the respective column; in the inside of each guide, a trolley 9 respectively 9*a* is mounted that can translate vertically in both directions, said trolleys being also of a known type and driven by ratio-motors associated to programmed controls.

On each trolley 9 and 9*a* a coil of plastic film 10 respectively 10*a* is freely revolvingly mounted, arranged at a vertical axis and provided with an usual braking device (not represented) to allow a regular tensioning of film 11–11*a* being unwrapped; each trolley 9–9*a* is activated in a known manner by a ratio-motor, also not represented, being widely known. Besides, to each trolley two film cutting devices are associated, indicated by 13, 13*a*, that step in on conclusion of each wrapping around the load, while two pliers 12 respectively 12*a*, of the type having two compass-like openable arms or jaws or the like, are stably associated to the revolving platform 6 respectively presser 8.

In this case (FIG. 2), i.e. in the case of a wrapping machine of the type with a revolving platform and a load 7 mounted on a motor-driven roller-set 6, to be in condition of performing a complete wrapping of a load with one only run of each coil and of allowing its moving away on an usual roller conveyor belt, indicated by 6*a* in FIG. 2, it is necessary to provide means for the reversal of the rotation direction of rollers 6*b* of the revolving platform, as, at the end of each run of a coil (i.e. upon completion of a helix) there would be present only the cutting device (for instance, the cutting device 13*a* in the case of coil 10*a*), being integral with the coil-holding trolley 9*a*; therefore, to be able to grip (after the cutting) the end of tape 11*a*, it is necessary to rotate the platform by a half turn, in order to bring said tape in correspondence of the gripping device 12, which is on the opposite site of the load.

This further rotation of platform 6 by a half turn, repeated also in the case of the- other wrapping with coil 10, involves the drawback that the wrapped load is not in the platform unloading direction, but is oriented in an opposite direction. Therefore, for this reason, in case of two like devices for cutting and gripping the film, it is necessary to reverse the rotation direction of the roller-set of the revolving platform after each of the two simultaneous wrappings. Not to have to reverse the rotation direction of the platform roller-set, it is possible to provide for cutting arms 13 and 13*a* (FIG. 2) to be so structured as to hold the film after the cutting upon conclusion of each wrapping, leaving also present the gripping pliers 12 and 12*a*, integral with the platform and presser 8. The roller-set of the load may therefore be motor-driven in one only direction.

According to another embodiment, two cutting devices may be provided, associated to two gripping pliers 12*b*–12*c* (FIG. 3), constituting one only device and stably anchored to the revolving platform 6 and presser 8; however, in this case the roller-set 6*b* of the revolving platform must be motor-driven in both directions.

Always to prevent the reversal of the rotation direction of the revolving platform rollers, there may be provided four gripping pliers (FIG. 3*a*), two of which, indicated by 13*b*–13*c*, are integral with the revolving platform, and two, indicated by 13*d*–13*e*, are integral with presser 8, as well as two cutting arms 12*d*–12*e*, integral with the coil-holding trolleys; there may be also utilised four like pliers associated to cutting blades, indicated by 12*f* in FIG. 3*b*, two of which are associated to the revolving platform and two to presser 8; also in this case, the platform roller-sets remains motor-driven in one only rotation direction.

There may be also provided other combinations of the various film cutting and gripping devices described hereinabove, which can all allow the motor-driving of the platform roller-set, either in one or in both directions.

The plastic film 11–11*a* utilised with these apparatuses may be of the extensible self-sticking, thermo-retractable type or the like; preferably an extensible, self-sticking film is utilised, having a width comprised between 500 and 600 mm, in order to obtain a minimum consumption, to improve the adjustability or adhesion of the film to the shape of package 7 and to obtain at the same time a greater production capacity. In fact, the apparatus described hereinabove allows to obtain two separate wrappings with partly superposed helixes, by means of the simultaneous shifting of the two coils 10–10*a* and one only run (starting from down upwards or also vice-versa) of both coils.

Therefore, the use of two alternately translatable coils to perform the wrappings with a spiral partly superposed around the load allows to reduce the packing time up to about half time compared to the present one-coil packing machines, to realise the two wrappings required.

Besides, the use of two coils than can translate simultaneously in a direction opposed relatively to the load to be packed involves also the great advantage of requiring—the production capacity being the same as that of the known machines—markedly smaller overall dimensions and very reduced costs as concerns both the real plant and the protection for those who perform the packing.

Always according to the invention, the practical and economic advantages achievable by the revolving platform apparatus described hereinabove, are achieved also by using rotary arm and fixed platform apparatuses.

In fact, as shown by FIG. 4 and 5, a packing machine of the type with a coil-holding rotary arm may be provided with two separate coils, realising in this way the wrapping process in about half the time, as is the case for the wrapping machine described and illustrated in FIGS. 1–3.

In FIGS. 4 and 5, the packing machine is realised to a great extent according to the known art, namely with a fixed platform 6*b* supporting load 7*a*, an adjustable presser 8*a* and pliers and cutting means either of a known type or a particular type, as those illustrated in FIGS. 3, 3*a* and 3*b*.

This apparatus includes, differently from the known rotary arm one, two arms 14–14*a* (clearly visible in FIG. 4) supported by a tie-rod 15, which is revolvingly supported in its turn by a horizontal beam 16, supported in its turn by two opposite uprights 17–17*a*. Said tie-rod 15 and the related arms 14–14*a* are driven by a ratio-motor 18 of a known type, slave to a suitably programmed electronic logic. On both arms 14–14*a* a trolley 19 respectively 19*a* is mounted that can translate in both directions, holding each a plastic film coil 20 respectively 20*a*. Said coil-holding trolleys are caused to be translatable along guides obtained within or caused to be integral with the arms, and their run is adjustable in a known manner, according to the height of the palletised load 7*a* to be wrapped.

Besides, also these coils may translate according to an alternate start, namely from down upwards and vice-versa, as in the case of the apparatus of FIGS. 2 and 3; besides, according to a first embodiment (FIG. 4) an usual cutting arm 21 is integrally anchored to upright 17*a* or the ground, while a pliers 22 is stably anchored to the fixed platform 6*b*; besides, a combined gripping and cutting device 22*a* in anchored on the upper presser 8*a* (FIG. 4).

According to another embodiment, illustrated in FIG. 5, two like combined gripping and cutting devices 21*a* are anchored both in the presser 8*a* and in the roller conveyor belt 6*a*.

Therefore, each run of coil 20 (either upwards or downwards) performs a spiral wrapping as, when the load is still, the coil rotates about the load and, at the same time, translates vertically; at the same time, coil 20*a* makes a run in contrary direction relatively to the direction of coil 20, thus performing the second wrapping.

From what has been expounded hereinabove, also this wrapping machine provided with two rotary arms and two coils that can translate alternately with respect to the fixed load, can achieve all the advantages achievable with the revolving platform wrapping machine.

Obviously in the practice, structurally and functionally equivalent modifications and variants may be introduced in the invention as has been described and illustrated according to some embodiments of the same, without falling outside the protection scope of said invention.

I claim:

1. A wrapping machine for wrapping palletized loads, comprising:

a revolving platform:

two upright members arranged on opposite sides of the revolving platform;

a superimposed lid pressing on the load;

a continuous guide arranged in each of said upright members and slidable in two vertical directions;

a trolley holding a plastic film coil positioned within each of said guides for moving in two vertical directions along said vertical members;

a braking device connected to said film coil for tensioning the film;

at least one cutting device associated with each trolley for cutting the film after wrapping each load;

at least two plier devices, one of said plier devices being integral with said revolving platform and the other within said lid to hold the film after cutting, wherein the load is wrapped via two spiral helices partially superimposed on each other during a single vertical run of each of said plastic film coils, through simultaneous and alternate translation of said two plastic film coils.

2. A wrapping machine according to claim 1, wherein said revolving platform further comprises:

a plurality of motor-driven rollers connected to a rotating drive for rotating the rollers in two directions to allow a ½ turn rotation of the platform at the end of a wrapping, to permit the film to be cut and held by said cutting and plier devices, respectively, and wherein all of said cutting and plier devices are shared by the other film coil.

3. A wrapping machine according to claim 1, wherein there are four plier devices and four cutting devices, two plier devices and two cutting devices being integral with the platform and two plier devices and two cutting devices being integral with the lid.

4. A wrapping machine according to claim 1, wherein the film is an extensible self-sticking plastic film having a width of between 500 mm and 600 mm.

5. A wrapping machine for wrapping palletized loads, comprising:

a fixed platform:

two upright members arranged on opposite sides of and perpendicular to the fixed platform;

two vertical arms revolving around the fixed platform;

a superimposed lid pressing on the load;

a trolley holding a plastic film coil vertically slidingly positioned via guides on each of said vertical arms to create two separate partially superimposed wrapping helices with alternate and simultaneous start of said trolleys;

a braking device connected to said film coil for tensioning the film;

two cutting arms for cutting the film after wrapping each load, each cutting arm being integral with one of said trolleys;

two plier devices, one of said plier devices being integral with said platform and the other within said lid to allow wrapping of the pallet via two spiral helices partially superimposed on each other during a single run of each of said plastic film coils, through simultaneous and alternate translation of said two plastic film coils.

* * * * *